United States Patent [19]

Welch et al.

[11] 4,441,663

[45] Apr. 10, 1984

[54] WEB CINCHING AND WINDING APPARATUS

[75] Inventors: Richard D. Welch, Pittsford, N.Y.; John G. Mulder, Kingston, Jamaica

[73] Assignee: Eastman Kodak Company, Rochester, N.Y.

[21] Appl. No.: 363,320

[22] Filed: Mar. 29, 1982

[51] Int. Cl.[3] ..... B65H 17/02; B65H 17/08; F16H 13/08

[52] U.S. Cl. ..... 242/65; 242/67.1 R; 242/68.1; 242/74; 74/798

[58] Field of Search ..... 242/65, 68.4, 67.1 R, 242/68.1, 67.2, 74; 74/798

[56] References Cited

U.S. PATENT DOCUMENTS

| | | | |
|---|---|---|---|
| 1,955,917 | 4/1934 | Jung | 242/68.1 |
| 1,964,076 | 6/1934 | Petersen et al. | 242/65 |
| 2,034,543 | 3/1936 | Twiss et al. | 242/67.2 |
| 3,207,452 | 9/1965 | Haskin, Jr. et al. | 242/68.1 X |
| 3,227,005 | 1/1966 | Johnson | 74/798 |
| 3,327,566 | 6/1967 | Hewko | 74/798 |
| 3,537,664 | 11/1970 | De Mallie et al. | 242/66 |
| 3,585,779 | 6/1971 | Thayer | 242/74 X |
| 3,692,252 | 9/1972 | Perconti | 242/65 X |
| 3,884,427 | 5/1975 | Hashimoto et al. | 242/67.1 R X |
| 4,344,590 | 8/1982 | Dean | 242/67.1 R X |

*Primary Examiner*—Stuart S. Levy
*Assistant Examiner*—Scott J. Haugland
*Attorney, Agent, or Firm*—S. W. Gremban

[57] ABSTRACT

To cinch a web end portion onto a web-free core, the core is driven by a core drive mechanism at an outer surface speed in excess of the speed at which the web end portion is fed to and threaded around the core. The core drive mechanism slips but continues to drive the core after the web end portion is cinched onto the core. After the web is wound to form a roll of predetermined diameter, the core drive mechanism is disengaged from the core to terminate the core drive. The outer surface of the partially built up roll further substantially simultaneously engages a builder roller which surface drives the roll.

The core drive mechanism further comprises a gudgeon for engaging and rotatably driving the core, and a rotatably mounted drive wheel which is driven by the builder roller. The drive wheel is coupled to the gudgeon by a bearing for driving the web-free core at an outer core surface speed greater than the web speed.

7 Claims, 4 Drawing Figures

WEB CINCHING AND WINDING APPARATUS

BACKGROUND OF THE INVENTION

1. Field of the Invention

The present invention relates generally to web handling, and more particularly to a web cinching and winding apparatus. To cinch the web end portion onto a core, the core is center driven at an outer surface speed greater than the transport speed of the web end portion fed to and threaded around the core. After the web end portion is cinched onto the core and the web wound to form a roll of predetermined diameter, the core center drive is terminated, and substantially simultaneously the outer surface of the roll is surface driven.

2. Description of the Prior Art

U.S. Pat. No. 3,585,779 discloses a winding apparatus in which a web end portion is cinched onto a spool by rotatably driving the spool at an outer surface speed in excess of the speed at which the web end portion is fed to and threaded around the spool. After cinching, the web is wound onto the spool by continued driving of the spool, commonly referred to in the industry as center drive winding.

It is also known in the prior art, of which U.S. Pat. Nos. 3,537,664 and 3,692,252 are exemplary, to initially attach or fasten a web end portion onto a core, and then drive the outer surface of web convolutions on the core by means of a builder roller to form a roll. This means of winding a roll is commonly referred to in the industry as surface winding.

A web cinching device is disclosed in U.S. Pat. No. 3,884,427 wherein web cinching is achieved by an endless belt wrapper. A wrapping mechanism wraps a belt almost completely around the outer periphery of a core leaving a small gap between the belt and core into which a web end portion is fed. After the web end portion is cinched onto the core, the belt is withdrawn.

Copending U.S. patent application Ser. No. 218,592 entitled "Web Cinching and Winding Apparatus and Method" by M. A. Kildal and S. J. Hassall filed on Dec. 19, 1980 describes a web cinching apparatus wherein web cinching and winding of web convolutions is initially achieved by center driving the core at a speed in excess of the web transport speed. After cinching and partial winding is achieved, the center driving of the core is terminated and the web is wound on the roll by surface driving the roll with a builder roller. Center driving of the core at a speed in excess of the web transport speed is achieved by resilient tires mounted on the periphery of the builder roller drivingly engaging cylindrical rims on a core chuck.

The prior art is further replete with speed reducing the increasing apparatus, of which U.S. Pat. No. 3,227,005 is exemplary, in which speed reducing and speed increasing is achieved by way of ball bearings.

One of the problems with winding devices in which the core is solely center driven is adequately controlling winding torque and web tension as the roll diameter increases, particularly where large rolls are wound. This has in instances necessitated the use of complicated and expensive control devices.

In winding devices in which the roll is solely surface driven, the web and core are traveling at the same speed. Since cinching a web end portion on a core can be defined as tightening a web by pulling on the web while holding the core (after the web end portion has entered the nip between the core and first web convolution) relative motion between the web and core is implied. Since relative motion between the web and core is not present in surface winding, cinching as defined above is unobtainable. In order to attach the web end portion to the core, means must be provided such as closely spaced threading guides, rollers or elastic bands surrounding the core to insure intimate contact of the web to the core. Such threading guides present problems, for example, of increased costs and reduced reliability due, among other things, to the precision required in manufacturing the parts, and the close tolerances involved in assembly and operation.

A problem with belt or band wrapping devices is difficulty of adjusting the device which is extremely critical. Improper adjustment of the belt wrapping device can result in web surface abrasion when the belts are around the core, and cinching failures with severe consequences. The belts further have to be replaced periodically.

A problem with web cinching apparatus of the type having tires fixedly mounted on the ends of a builder roller for driving a core chuck and core is that the tires are not axially adjustable on the roller. Such adjustability is necessary to accommodate axially adjustable core chucks for handling cores and slit webs of varying width.

SUMMARY OF THE INVENTION

In accordance with the present invention, a web cinching and winding apparatus is provided for automatically cinching the end portion of a web onto a cylindrical core and winding convolutions of web on the core. The web cinching and winding apparatus comprises an outer core surface spaced from a cylindrical roll drive surface on a builder roller. Means are provided for transporting a web end portion through the space between the core and roll drive surface at one speed. Web guide means are provided for threading the web end portion around the core. A rotatably mounted gudgeon drivingly engages the core, and a drive wheel preferably rotatably mounted on the gudgeon is driven by the roll drive surface. Means are provided for coupling the drive wheel to the gudgeon for driving the web-free core at an outer peripheral speed in excess of the web speed for automatically cinching the web end portion onto the core. After cinching, the core, due to core drive slippage, for example, is no longer overdriven and continued driving of the core winds a plurality of convolutions of web onto the core to form a roll. During the time that the drive wheel and gudgeon are in the core driving position, the roll drive surface on the builder roller is in a roll disengaged position due to the aforementioned spacing between the outer core surface and roll drive surface. The normally engaged surfaces of the drive wheel and builder roller are further responsive to the surface of the roll as it builds up. When the roll builds up to a predetermined roll diameter, the outer surface thereof engages the roll drive surface of the builder roller. Subsequent windings on the roll push the core chuck and drive wheel into a builder roller disengaged position for terminating driving of the core by the drive wheel. Substantially simultaneously, the roll drive surface of the builder roller in engagement with the outer surface of the roll drives the roll by surface winding to continue winding web convolutions thereon.

In further aspects of the invention, the gudgeon is rotatably mounted on a bearing having an outer race secured to the gudgeon, a non-rotatable inner race, and rotatable bearing members interposed therebetween. The means coupling the drive wheel to the gudgeon comprises a bearing cage having one portion thereof secured to the drive wheel and an inner portion thereof connected to the rotatable bearing members. Accordingly, rotation of the drive surface of the drive wheel at web speed will rotate the gudgeon and outer surface of the web-free core via the bearing at a speed in excess of the web speed for cinching the web end portion onto a core. After cinching, overdriving of the core is discontinued by virtue of core drive slippage, for example, and continued driving of the drive wheel winds convolutions of web on the core to form a roll.

One of the advantages of this invention is the rotation of the slit web take-up core at a surface speed in excess of the web speed. A further advantage is to accomplish this without limiting in any way the width of a web slit from a master roll. This is achieved by mounting a core chuck mechanism on at least one core support arm that is axially adjustable along the length of a builder roller to accommodate cores and slit webs of varying width. The core chuck mechanism comprises a drive wheel that is driven directly by the outer surface of the builder roller, and hence is readily axially adjustable along the length of the roller along with the core support arm.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 2:
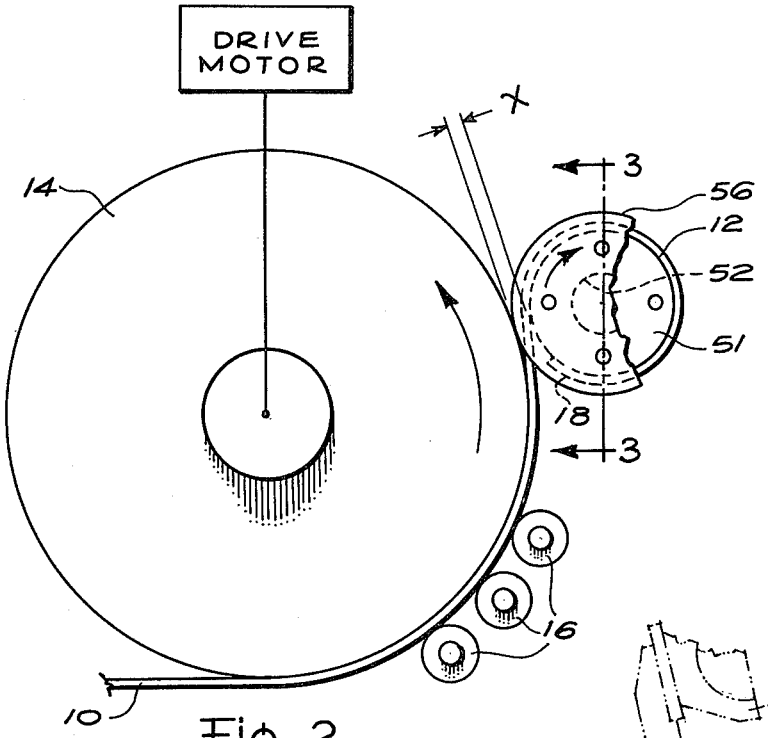
FIG. 2 is an enlarged segmental view of the builder roller and core chuck mechanism of FIG. 1 with a portion thereof broken away, and further showing a web end portion about to be cinched on the core.
Figure 1:
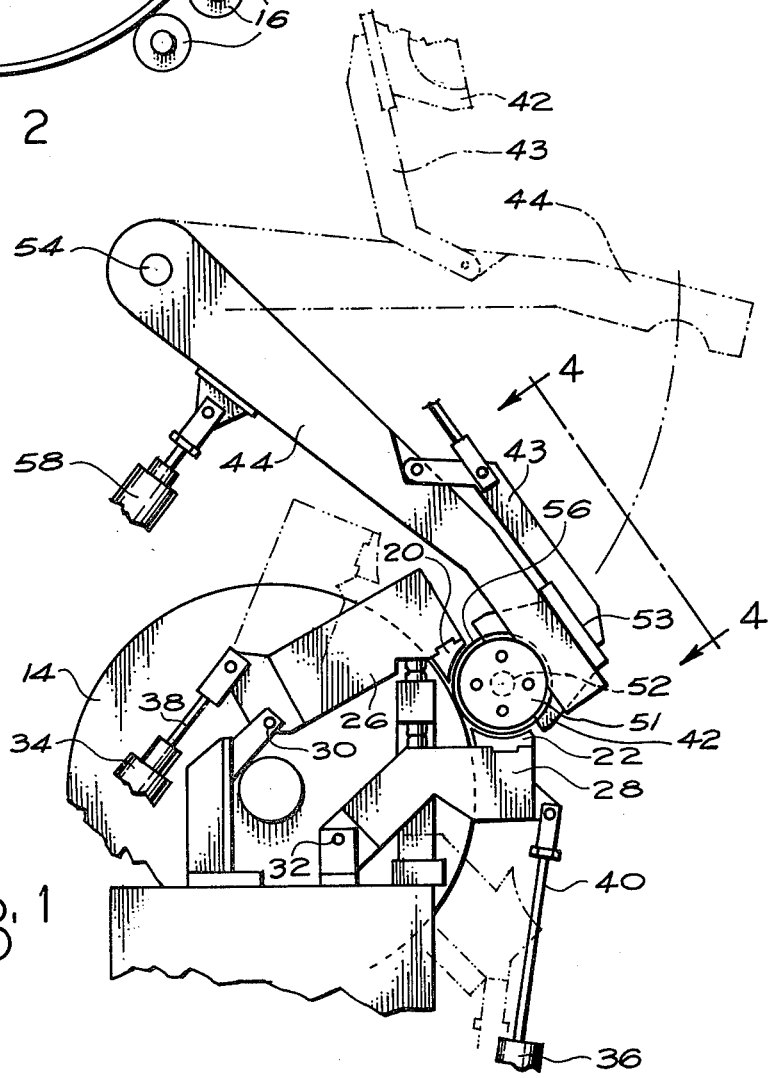
FIG. 1 is a segmental side elevational view of a preferred embodiment of a web cinching and winding apparatus of this invention with portions of the builder roller support frame and drive means and other mechanisms omitted for purposes of clarity.

Referring to FIGS. 1 and 2 of the drawings, a preferred embodiment of apparatus for cinching and winding a web 10 on a core 12 is illustrated. The web of film, paper or the like is initially fed by any suitable means, not shown, into the nip between a builder roller 14 and the first of a plurality of idler rollers 16. The builder roller 14 is driven by any conventional drive motor shown in block diagram form in FIG. 2 for transporting web 10 around the outer surface of web-free core 12 onto which the leading web end portion 18 is cinched by overdriving the core relative to the web. After cinching, core 12 is no longer overdriven and builder roller 14 drives core 12 by means to be explained hereinafter to wind the web onto the core to form a roll.

Figure 4:
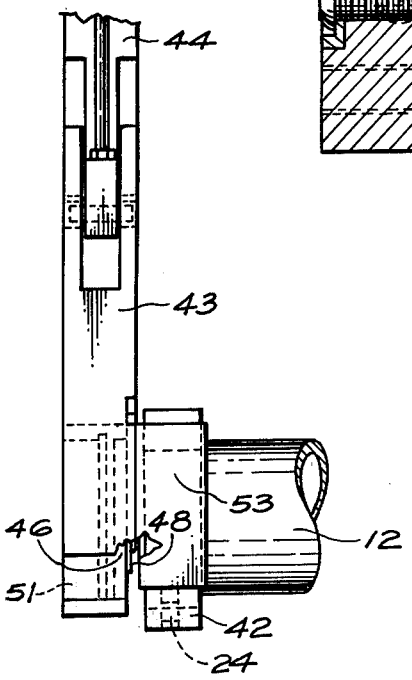
FIG. 4 is a segmental top plan view of one of the core chuck support arms taken substantially from line 4—4 of FIG. 1.

Web guide means are provided as shown in FIGS. 1 and 4 for guiding the web end portion 18 around core 12 for cinching. The guide means comprise upper and lower arcuate cinch shoes 20, 22 respectively extending along the length of builder roller 14 and having guiding surfaces spaced from and conforming to the outer surface of the core for guiding the web around a portion of the outer surface of the core. The upper and lower shoes 20, 22 respectively are secured at each end to arms 26, 28 respectively which are pivotally mounted on fixed pivots 30, 32 respectively. Shoes 20, 22 are pivotally movable by pistons 34, 36 respectively between a guiding position as seen in full lines, and a retracted position shown in phantom. Pistons 34, 36 have piston rods 38, 40 respectively pivotally secured to arms 26, 28 respectively.

Separate guide means are provided for guiding web end portion 18 around the portion of the outer core surface extending between cinch shoes 20, 22. The guide means comprises arcuate guide shoes 42, one mounted on each end of an arm 43 pivotally mounted on a core support arm 44, as best seen in FIG. 4. Each guide shoe further rotatably supports a spring biased roller 24 for pressing the leading end of the web into engagement with the outer surface of the core. The opposite end of each arm 44 is pivotally mounted on a spindle 54 extending from a support frame, not shown.

Figure 3:
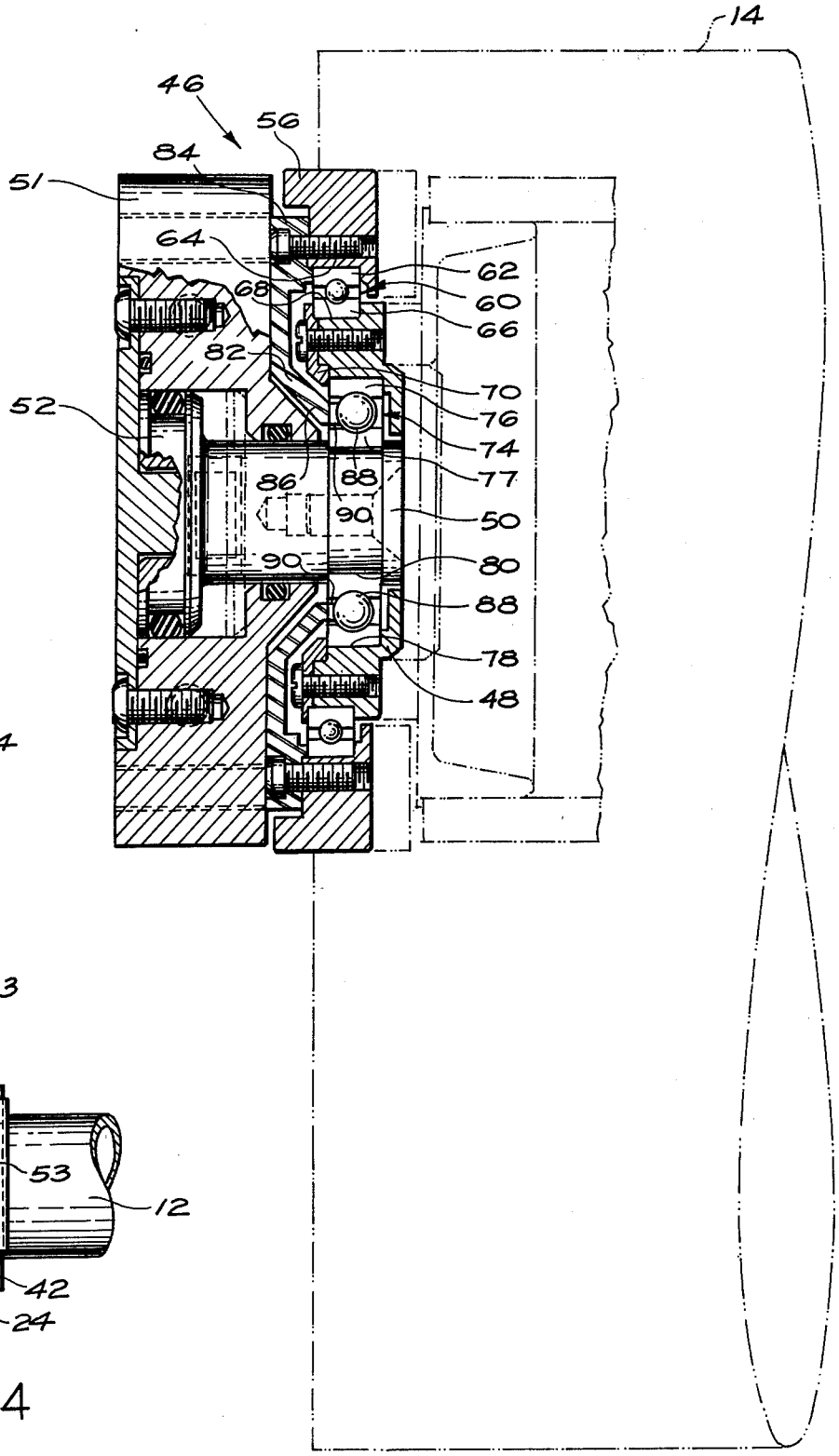
FIG. 3 is an enlarged section view taken substantially along line 3—3 of FIG. 2.

With reference to FIGS. 3 and 4, the core driving means for center driving core 12 comprises core chucks 46 at each end of the core. Each core chuck has a gudgeon 48 rotatably mounted on a spindle 50 journaled in a housing 51 which is secured to arm 44 by any suitable means, not shown. Spindle 50 is axially movable, in response to a fluid cylinder 52, for moving the gudgeon between core engaged and disengaged positions. The gudgeon 48 is shown in a core disengaged position in FIG. 3 in full lines, and in a core engaged position in broken lines. Each core chuck 46 has a drive wheel 56 engageable with and driven by the outer surface of builder roller 14. The drive wheels 56 are forced into frictional engagement with the builder roller by pivoting arms 44 downwardly by gravity and any other means such as an air cylinder 58 (FIG. 1), for example.

Each drive wheel 56 is preferably rotatably mounted on a gudgeon 48 by means of any suitable bearing, such as a ball bearing 60. An outer race 62 of the bearing is seated in a circular groove 64 in the drive wheel, and an inner race 66 is seated in a peripheral groove 68 in gudgeon 48. A bearing retainer plate 70 is secured by screws to the gudgeon for retaining bearing 60 in place. The gudgeon 48 is also rotatably mounted on axially movable, but non-rotatable spindle 50 by means of a bearing 74, also shown as a ball bearing. An outer race 76 of bearing 74 is seated in a circular groove 78 in the gudgeon, and an inner race 77 is seated in a peripheral groove 80 on the spindle 50. An annular bearing cage 82 of conventional type has its outer rim 84 secured to drive wheel 56 by screws, and its inner rim 86 coupled to balls 88 in bearing 74 by fingers 90 extending between the balls or openings in the rim within which the balls are nested. Accordingly, rotation of drive wheel 56 and bearing cage 82 by rotation of builder roller 14 in engagement with the drive wheel imparts a rotation to balls 88. Since inner race 77 is stationary on spindle 72, portions of the rotating balls 88 in engagement with the inner race are at any instant also stationary whereas the diametrically opposed portions have a high surface speed such that the outer race 76 engaged thereby, gudgeons 48 and web free core 12 are all driven by the balls at a rotational speed greater than the rotational speed of bearing cage 82. Although the core 12 is of smaller diameter than drive wheel 56, the surface speed of the web free core due to the action of balls 88 is greater than the surface speed of the drive wheel. Accordingly when builder roller 14 is rotatably driven by the drive motor at a desired number of revolutions per minute for transporting web 10 at a selected web speed, the outer surface of the builder roller rotatably drives wheels 56 in engagement therewith at the same surface speed as the web. In turn, the drive wheels drive the web-free core through the gudgeons and balls at a predetermined surface speed greater than the selected transport speed of the web. The speed difference between the outer surface of web-free core 12 and web end portion 18, as the web end portion completes a single convolution and enters the nip between the outer surface of the core and web as seen in FIG. 2, results in a cinching or tightening of web end portion on the core. As soon as cinching is achieved and the core subjected to a predetermined web tension which exceeds the friction drive between balls 88 and races 20, 77, the balls slide or skid resulting in core-drive slippage and the core is no longer overdriven. As indicated earlier, after cinching, web 10 is wound onto the core by continued driving of the core through builder roller 14 and drive wheels 56.

As indicated earlier, core 12 has an outer diameter slightly less than the outer diameter of drive wheels 56 as best seen in FIG. 3. As a result, in the driving position of builder roller 14 and drive wheels 56, the roll drive surface or outer surface of the builder roller 56 is spaced a predetermined clearance space "x" from the outer surface of the core as best seen in FIG. 2.

In the operation of the web cinching and winding apparatus, the web end portion 18 is initially transported by builder roller 14 and guide rollers 16 through the clearance space "x", and is directed by shoes 20, 22 and 42 around the outer surface of the core where it is cinched. The builder roller 14 drives the core through drive wheels 56 until a sufficient number of web convolutions are wound on the core causing the diameter of a roll formed on the core to build up to the point where it exceeds the outer core diameter plus twice the clearance space "x". At this point, the outer web convolution on the roll frictionally engages the roll drive surface of builder roller 14 which begins to surface drive the roll. Substantially simultaneously, the outer web convolution of the roll forces core 12 and arms 44 in a counter-clockwise direction when viewed in FIG. 1 causing drive wheel 56 to disengage the roll drive surface of the builder roller 14 and terminate driving the core. The remaining web convolutions are surface wound onto the roll by means of the roll drive surface.

The invention has been described in detail with particular reference to a preferred embodiment, but it will be understood that variations and modifications can be effected within the spirit and scope of the invention as described.

What is claimed is:

1. An apparatus for automatically cinching the end portion of a web onto a cylindrical core and winding convolutions of web on the core to form a roll, said apparatus comprising:

a roller having a roll drive surface spaced from the outer surface of the core;

means for transporting a web between said roll drive surface and outer core surface;

means for guiding the end portion of the tranported web around the outer surface of the core and into a nip formed by the web and outer core surface;

a rotatably mounted gudgeon adapted to drivingly engage the core for rotating the core;

a rotatably mounted drive wheel normally rotatably driven by said roll drive surface; and means directly coupling said drive wheel to said gudgeon whereby said gudgeon rotates the core at an outer core surface speed greater than said web spread for cinching the end portion of the web onto the core.

2. A web cinching apparatus according to claim 1 wherein said drive wheel is rotatably mounted on said gudgeon, and further comprising a bearing having an outer race secured to said gudgeon, a fixed inner race, and rotatable bearing members interposed therebetween, and said drive wheel has a cylindrical surface engageable by said roll drive surface.

3. A web cinching apparatus according to claim 2 wherein said coupling means comprises a bearing cage having an outer portion thereof secured to said drive wheel, and an inner portion thereof connected to said rotatable bearing members.

4. A web cinching apparatus according to claim 1 wherein said drive wheel is rotatably mounted on said gudgeon, and further comprising a non-rotatable member onto which said gudgeon is rotatably mounted, a bearing interposed between said gudgeon and said non-rotatable member, said bearing having an inner race secured to said non-rotatable member, an outer race secured to said gudgeon, and rotatable bearing members interposed between said inner and outer races, and said drive wheel has a cylindrical flange engageable by said roll drive surface.

5. A web cinching apparatus according to claims 2 or 4, and further comprising a second bearing interposed between said drive wheel and said gudgeon, said second bearing having an outer race secured to said drive wheel, an inner race secured to said gudgeon, and rotatable bearing members interposed therebetween.

6. A web cinching apparatus according to claim 4 wherein said coupling means comprises a bearing cage having an outer portion thereof secured to said drive wheel, and an inner portion thereon connected to said rotatable bearing members.

7. A web cinching apparatus according to claims 4 or 6, and further comprising means for axially moving said non-rotatable member between two positions for moving said gudgeon into and out of driving engagement with said core.

* * * * *